US006223950B1

(12) United States Patent
Lasko

(10) Patent No.: US 6,223,950 B1
(45) Date of Patent: May 1, 2001

(54) BULK FEED GLUE GUN

(76) Inventor: Bernard C. Lasko, 2605 Colonial Pkwy., Fort Worth, TX (US) 76109

( * ) Notice: Subject to any disclaimer, the term of this patent is extended or adjusted under 35 U.S.C. 154(b) by 0 days.

(21) Appl. No.: 09/470,373

(22) Filed: Dec. 22, 1999

Related U.S. Application Data

(60) Provisional application No. 60/113,448, filed on Dec. 23, 1998.

(51) Int. Cl.[7] ..... B67O 5/62

(52) U.S. Cl. ..... 222/146.5; 239/85; 219/426; 219/634; 219/635; 219/674; 222/630; 222/413

(58) Field of Search ..... 239/81, 85, 135; 219/420, 426, 633, 634, 635, 674; 222/146.5, 630, 413

(56) References Cited

U.S. PATENT DOCUMENTS

| | | | | |
|---|---|---|---|---|
| 2,465,283 | * | 3/1949 | Schlehr | 219/634 X |
| 3,043,480 | * | 7/1962 | Wittrock | 222/146.5 |
| 3,543,968 | * | 12/1970 | Reighard | 222/146.5 |
| 3,677,471 | * | 7/1972 | Deakin | 239/85 |
| 3,750,905 | * | 8/1973 | Wolfrom | 222/146.5 X |
| 4,197,070 | * | 4/1980 | Koschmann | 222/146.5 X |
| 4,804,110 | * | 2/1989 | Sperry et al. | 222/146.5 X |
| 5,005,731 | * | 4/1991 | Koehler et al. | 222/146.5 X |
| 6,042,019 | * | 3/2000 | Rusch | 239/85 |

* cited by examiner

*Primary Examiner*—Kenneth Bomberg
(74) *Attorney, Agent, or Firm*—James E. Bradley; Bracewell & Patterson, L.L.P.

(57) ABSTRACT

An apparatus such as a glue gun system that utilizes solid beads of meltable material such as glue. The glue gun has a housing that contains a pervious barrier. The pervious diaphragm separates the beads from an airstream that is used to deliver the beads from a hopper to the housing. A load level control detects varying levels of the beads in the housing. A motor in the interior of the housing drives a feed screw. The feed screw forces the beads towards a nose assembly on the forward end of the housing. A heating element is provided in the nose assembly. A co-axial hose delivers the beads from a hopper to the housing through an interior passage. An exterior annulus of the hose delivers the separated airstream away from the housing. Electronics control the rotation of the feed screw and controls the power to the heating element. A hopper contains beads of the meltable material. An electric metering device is located in the hopper for regulating the amount of beads placed into the airstream within the interior passage of the co-axial hose.

15 Claims, 3 Drawing Sheets

BULK FEED GLUE GUN

CROSS-REFERENCE TO RELATED APPLICATIONS

This application claims the benefits of provisional application Ser. No. 60/113,448, filed Dec. 23, 1998, in the United States Patent & Trademark Office.

TECHNICAL FIELD

A method and apparatus for delivering melted material. More particularly, the apparatus is a glue gun utilizing a bulk feed to deliver meltable material, such as glue, to the apparatus for delivery of molten glue without unwanted drips and at a controlled temperature.

BACKGROUND OF THE INVENTION

Prior art devices have been utilized for heating and dispensing materials, such as for heating a solid material until it melts and then dispensing the material as a liquid. For example, hot glue guns are used for heating an end of a solid glue stick to a transition temperature at which the glue is liquified and then dispensing the melted glue through a dispensing orifice. Typically, a housing is provided having an interior flow path through which the material is pushed as it is heated. Resistance heating elements are commonly used. The resistance heating elements have been mounted to the housing outside of the flow path, and often outside of the housing.

Other devices have utilized induction heating to heat materials for dispensing. A housing is usually provided having an interior flow path through which the material is pushed as it is heated. An electromagnetically heated susceptor is located either directly in or immediately adjacent to the material flow path. Induction coils have been mounted outside of the housing for inducing eddy currents to flow within the susceptors to generate heat for transferring to the materials. Often an external shroud is provided around the induction coil to protect an operator.

A difficulty with prior devices is that once the meltable materials have been melted and dispensed, it is difficult to cease flow of the meltable material without additional and unwanted drips emerging from the nozzle. The additional flow is partially due to a large orifice in the nozzle and to an area of high pressure resulting from compression of the meltable material from the pusher used to force a material towards the heating elements. An additional inconvenience associated with prior devices is that the apparatus may only be used for a limited amount of time before the glue stick must be replaced.

SUMMARY OF THE INVENTION

A glue gun system utilizes solid beads of glue that are delivered from a hopper through a hose with an airstream. The glue gun has a housing that contains a pervious barrier. The pervious barrier is provided for separating the beads from the airstream and for providing a load level control for detecting varying levels of the beads in the interior of the housing.

A handle is provided on the underside of the housing. A trigger mechanism is located on a forward side of the handle for activating a motor in the interior of the housing. A feed screw is operatively connected to a front end of the motor for forcing the beads towards the forward end of the housing.

A nose assembly is provided on the forward end of the housing. The nose assembly has a conical housing cone with a central orifice for delivery of the melted beads to a workpiece. A conical inductor is received within the conical housing cone and also has a central orifice. A conical susceptor is received within the conical inductor. The conical susceptor has a plurality of holes formed thereon and defines a central orifice. A conical displacement cone is received within the conical susceptor. A nozzle is positioned within the central orifice of the conical housing, the conical inductor and the conical susceptor. A cable operatively connects the conical susceptor with a power source. A co-axial hose has a lead end, an interior passage and an exterior annulus. The co-axial hose passes through the handle into the interior of the housing for delivering beads of material to the interior of the housing through the interior passage. The exterior annulus of the hose is used for return delivery of the separated airstream.

A PC board has electronics for controlling the forward or rearward rotation of the feed screw and for controlling a flow of power over the cable to the conical susceptor, A hopper is provided for containing beads of the meltable material. The hopper is connected to a lead end of the co-axial hose. An electric metering device is located in the hopper for regulating the amount of beads delivered into the airstream within the interior passage of the co-axial hose.

DETAILED DESCRIPTION OF THE INVENTION

Figure 1:
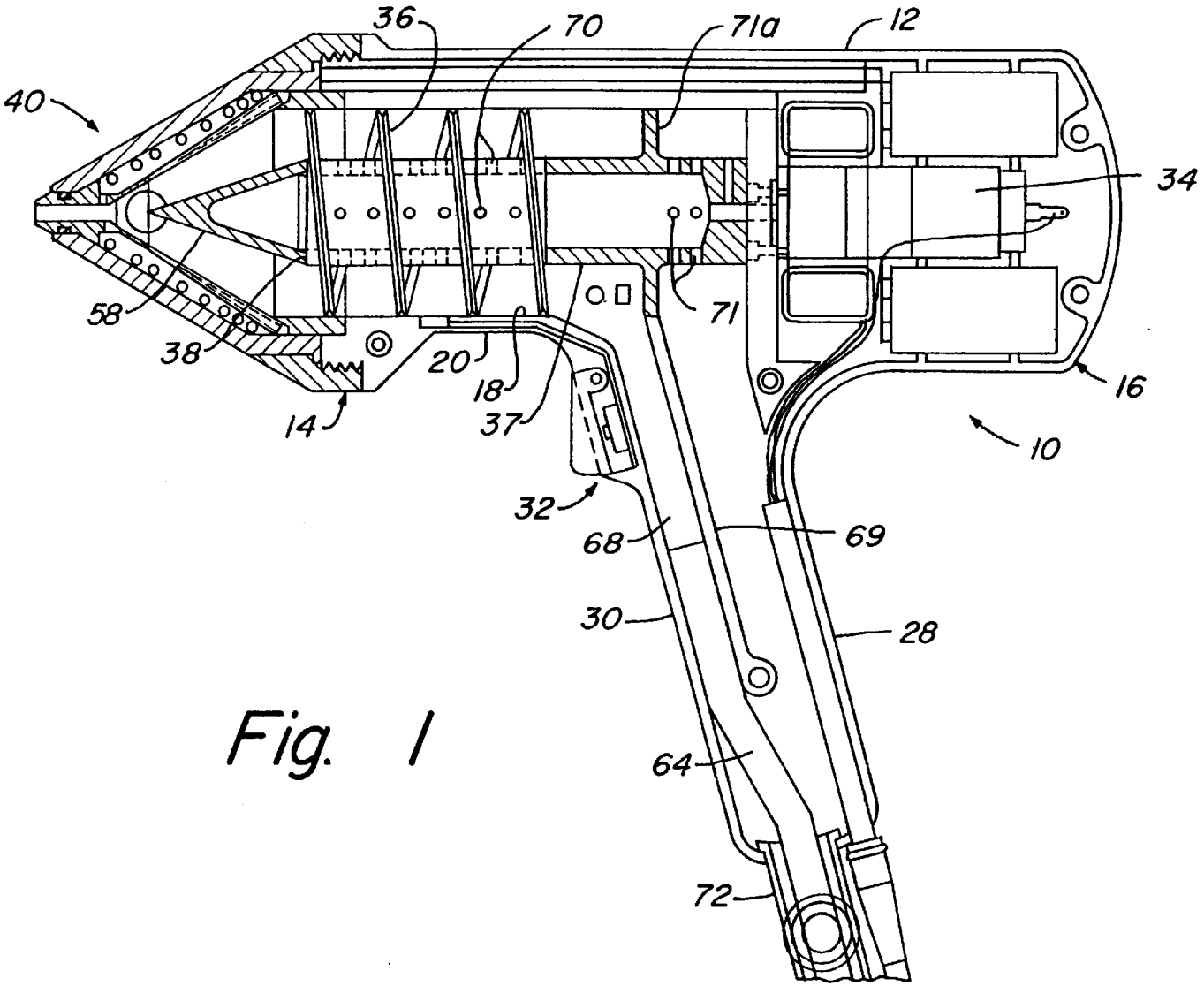
FIG. 1 is an elevational cross-sectional view of the glue gun of the invention.
Figure 2:
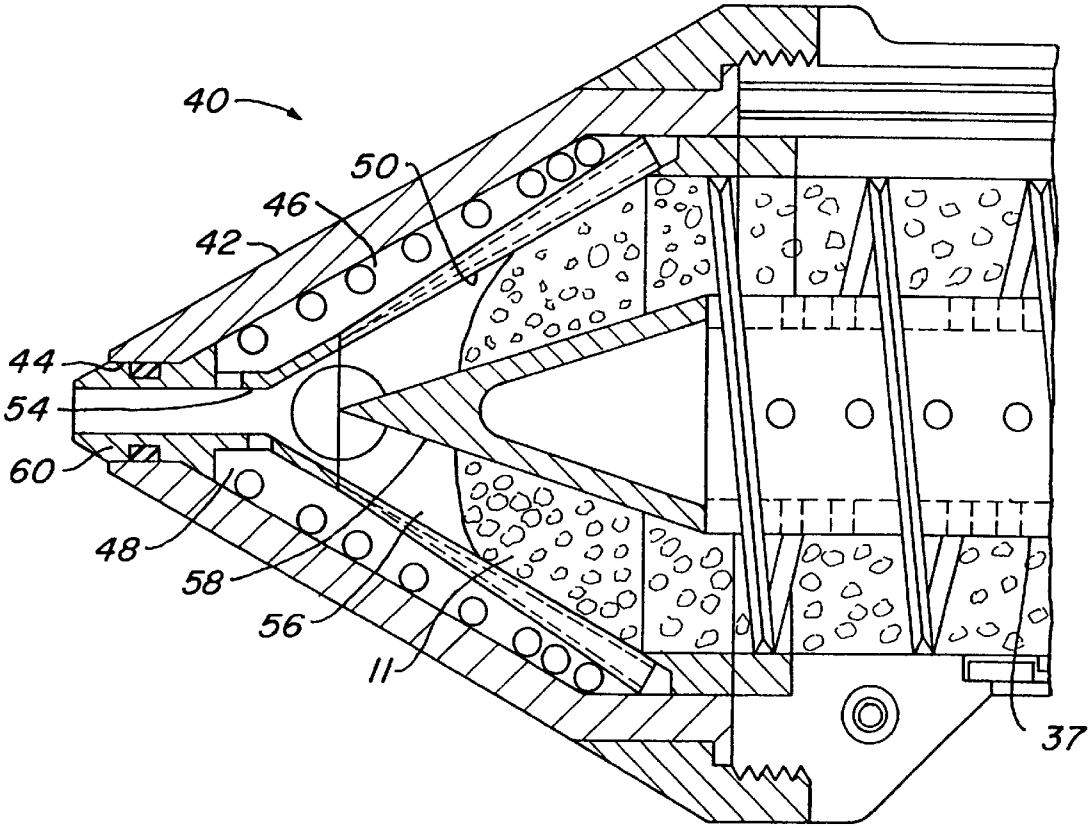
FIG. 2 is an enlarged elevational cross-sectional view of the nose assembly of the glue gun of FIG. 1.

Referring now to FIGS. 1 and 2, a glue gun designated generally 10 utilizes solid pellets 11 (FIG. 2) of glue. Glue gun 10 includes a housing 12 having a forward end 14, a rearward end 16, an interior 18, and an underside 20. A handle 28 is positioned on underside 20 of housing 12. Handle 28 has a forward side 30 having a trigger mechanism 32 positioned thereon. A motor 34 is positioned within interior 18 of housing 12. Motor 34 drives a feed screw 36 or auger mounted on a screw barrel 37, which is driven by motor 34.

Capacitors 35 and transformer 33 are mounted in housing 12 around motor 34. A controller and power supply 39 (FIG. 4) is located exterior of housing 12 in this embodiment. Controller 39 could be mounted in housing 12. Controller 39 controls forward and rearward rotation of screw 36.

Preferably, the speed of rotation of feed screw 36 may be varied by the amount of pressure on trigger mechanism. Screw barrel 37 is supported on a forward end of a stationary displacement cone 58 by a slip joint 38. Feed screw 36 forces pellets 11 toward forward end 14 of housing 12.

A nose assembly 40 is positioned on forward end 14 of housing 12. As seen more clearly in FIG. 2, nose assembly 40 includes a conical housing cone 42 having a central orifice 44. A conical inductor 46 is received within conical housing cone 42. Conical inductor 46 has a central orifice 48. Inductor 46 is a coil of wire.

Figure 3:
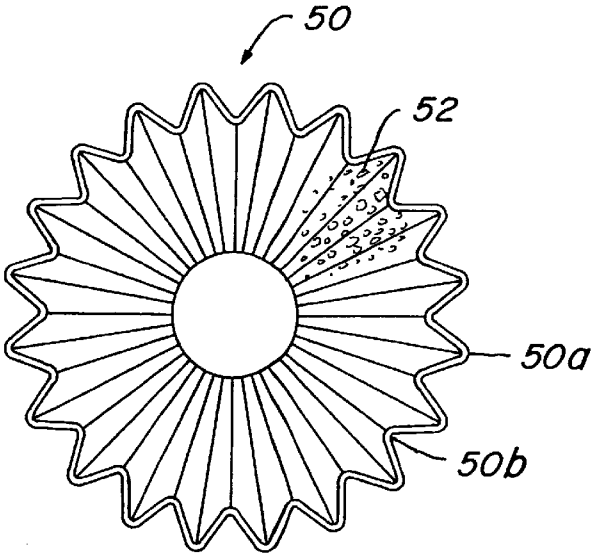
FIG. 3 is an elevational end view of a conical susceptor in the nose assembly of FIGS. 1 and 2.

An electrically conductive conical susceptor 50, shown in greater detail in FIG. 3, is received within conical inductor 46. Conical susceptor 50 is preferably folded or corrugated to provide greater surface area for increased heat transfer. The folds extend lengthwise from the base to the apex of conical susceptor 50. The folded conical susceptor 50 increases the ratio of surface area to mass by 34% over a non-folded conical design. The speed of heat transfer is increased from the surface of susceptor 50 to the pellets 11. Preferably, the peaks 50*a* of the corrugations form a 55° angle and the troughs 50*b* form a 73° angle. Conical susceptor 50 is preferably a 0.018 inches thick with a plurality of 0.033 inch diameter holes 52, such that conical susceptor 50 is 28% open. The geometry of the folded susceptor may be formed by a die processor a perforated steel sheet. Preferably, the induced current follows the folded form at the low power density applied (180 watts/sq. inch) in this process. Conical susceptor 50 additionally defines a central orifice 54. Conical susceptor 50 defines an elastic zone 56 (FIG. 2) that is between conical susceptor 50 and pellets 11.

A stationary conical displacement cone 58 is received within conical susceptor 50 and mounted on a forward end of screw barrel 37. The forward end of displacement cone 58 is supported rearward of orifice 54. A nozzle 60 is positioned within central orifices 44 and 48. A power cable is operatively connected with the conical inductor 46 and with power source 39.

Figure 4:
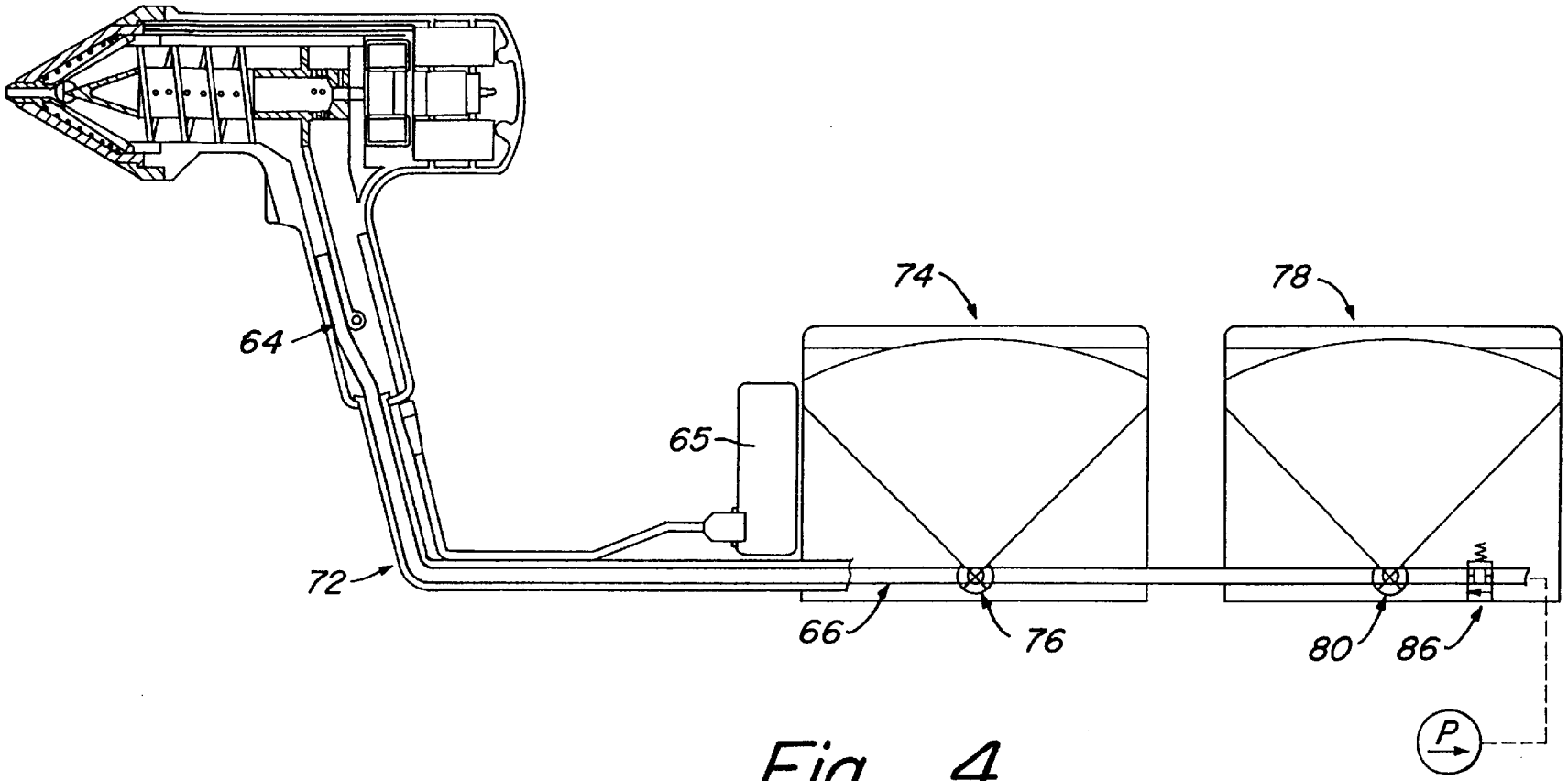
FIG. 4 is a schematic view of the glue gun and hopper system of the invention.

Referring to FIGS. 1 and 4, an inner hose 64 is provided for delivering air pressure. Inner hose 64 passes into handle 28 and terminates within integral passage 68 (FIG. 1). Integral passage 68 is formed by barrier 69 in handle 28. Integral passage 68 communicates with interior 18 of housing 12 and delivers pellets 11 propelled by air pressure to interior 18 of housing 12. Pellets 11 are delivered to an area proximate feed screw 36. Feed screw 36 delivers pellets 11 to the forward end 14 of glue gun 10.

A pervious screw loading system utilizes holes 70 in the screw barrel 37 to separate the air delivered pellets 11 from the returning air. Air used to transport pellets 11 is routed from passage 68 through intake holes 70 in screw barrel 37. The air passes through screw barrel 37 and exits through exit holes 71. Intake holes 70 and exit holes 71 are separated by flange 71 a. These passages 70, 71 along with a negative differential in the hydraulic pressure on the melt face separates the approximately 50% air by volume from the compressing pellets 11. The air then passes down a back side of barrier 69 through handle 28 and out through an annulus between outer hose 72 and inner hose 64 for return delivery of the separated airstream. Holes 70 in screw barrel 37 are smaller in diameter than the cross-sectioned area of pellets 11, preventing pellets 11 from entering holes 70.

A first hopper 74 (FIG. 4) is provided to contain pellets 11. Hopper 74 is connected to air conduit of an air compressor 67, conduit 66 being connected to inner hose 64. Electric metering device 76 is provided within first hopper 74 for placing pellets 11 into the airstream of inner hose 64. In one embodiment, a second hopper 78 is provided having an electric metering device 80 upstream in conduit 66 from hopper 74. The rotation of the variable speed feed screw 36 is related to the pellets/min metering monitored by devices 76 and 80 from the hopper. The pellet metering is interrupted as required by electronically sensing the rising air pressure as more intake holes or air passages 70 in the screw barrel 37 are blocked by the pellets 11 that are driven forward by feed screw 36.

First hopper 74 and second hopper 78 may be filled with different kinds of pellets 11. Melt phase compounding can be achieved by introducing multiple formulations of reactive pellets 11 in variable metering from multiple reservoirs such as hoppers 74 and 78. A percentage of different kinds of pellets 11 may be delivered to inner hose 64 so that the Ii resulting melted glue properties may be controlled. An electric valve 86 is provided to further control flow of air to deliver the pellets 11. A shift shut down purge of the susceptor and delivery screw can be achieved by forwarding only a singular formulation in the amount of the screw and susceptor volume (typically 0.7 to 1 oz. of material) and rejecting this amount upon restart.

In practice, first hopper 74 and/or second hopper 78 is/are filled with pellets 11 of meltable material. Electric metering device 76 and/or 80 allow(s) the appropriate amount of their respective pellets 11 to enter inner hose 64. An airstream within hose 64 delivers pellets 11 into integral passage 68 and into interior 18 of housing 12. Motor 34 rotates screw barrel 37 and feed screw 36. Feed screw 36 delivers pellets 11 to a forward end 14 of housing 12. Air passes through intake holes 70 of rotatable cylinder 37 and is directed through exit holes 71 for return delivery through outer hose 72.

As discussed above, pellets 11 are delivered to forward end 14 of housing 12 where pellets 11 come in contact with conical susceptor 50. The conical susceptor 50 is heated by magnetic field induction formed by inductor coil 46. Pellets 11 in contact with conical susceptor 50 are melted to form the elastic zone 56, as shown in FIG. 2. The melted pellets 11 are then delivered through susceptor holes 52, past the inductor coil 46, and out of nozzle 60 for application.

When trigger mechanism 32 is released, controller 39 (FIG. 4) automatically causes motor 34 to reverse screw barrel 37 and feed screw 36 approximately 15 degrees to relieve pressure on the elastic zone 56. This action reduces the hydraulic pressure on the down stream liquid zone to abruptly cut off the flow out of the nozzle at the end of an application cycle.

This invention has several advantages. The glue gun of the invention is designed to utilize pellets of glue, rather than glue sticks. Pellets of glue may be purchased in bulk and are cheaper than using traditional glue sticks. Typically, the price of pellets is 40% of the price of glue sticks for the same formulation in some volume applications. Additionally, the system of the invention cold starts much more quickly than a typical bulk melt system, e.g., two seconds for the system of the invention versus thirty minutes for the prior art bulk melt system.

When changing formulations of the glue pellets, the system may be purged by a different formulation in several seconds of clearing the susceptor. In contrast, the resistance heated bulk melt systems require an operator to clean out a melt pot, a displacement pump, and heated delivery hoses.

The entire contents of a delivered container, which is typically approximately 50 lbs, can be loaded in a hopper without interrupting the operation of the equipment. In contrast, current bulk systems require a pre-heater to add melted material to the melt pot or the interruption of the melt cycle when cold additions are made to the melt pot.

The applicator is light weight (approximately 2 lbs.) which provides the flexibility of delivery attitude since the glue gun is connected to the hopper with ⅝ inch OD low pressure PVC air hoses and a ⅜ inch diameter coaxial power delivery. In contrast, the resistance heated systems of previous designs are attached to the melt tank by a heavy heated and insulated delivery hose.

Folding the susceptor enables more energy to be continuously induced into the same diameter susceptor. Therefore, more energy can be transferred to the material at greater production rates. The susceptor's heat transfer efficiency is the major production rate limiting factor without increasing the diameter of the stick.

While the invention has been shown in only one of its forms, it should be apparent to those skilled in the art that it is not so limited, but is susceptible to various changes without departing from the scope of the invention.

What is claimed is:

1. An apparatus for dispensing melted material, comprising:

a handheld gun having a heating chamber and a nozzle leading from said heating chamber;

an auger located in said gun;

a motor connected to said auger for rotating said auger;

a hopper adapted to contain beads of meltable material;

a hose in communication with said hopper for receiving said beads, said hose being connected to said gun, allowing said gun to be remotely located from said hopper;

an air pressure source in communication with said hose for conveying said beads through said hose to said auger in said gun, which in turn moves said beads into said heating chamber; and a heating element in said heating chamber for melting said beads, said auger delivering said melted material out through said nozzle.

2. An apparatus for dispensing melted material, comprising:

a dispensing housing, having a heating chamber and a nozzle leading from said heating chamber;

said heating chamber being connected to a conduit leading to a hopper adapted to contain beads of meltable material for receiving said beads in said heating chamber;

said conduit being adapted to deliver beads through said conduit into said housing by air pressure;

a heating element in said heating chamber for melting said beads and delivering said melted material out through said nozzle;

an intake chamber in said housing adapted to be connected to said conduit for receiving said beads being delivered under air pressure; and a pervious barrier along a portion of said intake chamber for allowing air pressure to discharge from said intake chamber, but preventing the discharge of said beads.

3. The apparatus according to claim 2, further comprising:

a outlet chamber in said housing adapted to be connected to a return air line for discharging air pressure; and said pervious barrier being located between said intake chamber and said outlet chamber for discharging air from said intake chamber into said outlet chamber.

4. An apparatus for dispensing melted material, comprising:

a dispensing housing, having a heating chamber and a nozzle leading from said heating chamber;

said heating chamber connected to a conduit leading to a hopper adapted to contain beads of meltable material for receiving said beads in said heating chamber;

a heating element in said heating chamber for melting said beads;

an auger located in the housing of the dispensing unit;

a motor connected to said auger for rotating said auger, which in turn moves said beads in said heating chamber toward said nozzle, wherein:

said auger has a hollow axially extending barrel having a sidewall;

a pervious barrier is located in a portion of said sidewall containing apertures that are too small for the beads of material to flow through; and wherein previous barrier is adapted to allow air pressure from said conduit to flow into said barrel for discharge from said housing.

5. The apparatus according to claim 4, wherein said dispensing unit is a handheld gun, and said conduit comprises a hose, enabling said gun to be remotely located from said hopper.

6. An apparatus for dispensing melted material, comprising:

a dispensing housing, having a heating chamber and a nozzle leading from said heating chamber;

a hopper adapted to hold beads of meltable material;

a conduit connecting said hopper to said dispensing housing, said conduit adapted to be connected to a source of air pressure for delivering said beads under air pressure to said dispensing housing;

a heating element in said heating chamber for melting said beads and delivering said melted materia out through said nozzle;

an intake chamber in said housing in communication with said conduit for receiving said beads being delivered through said conduit; and a pervious barrier along a portion of said intake chamber for allowing air pressure to discharged from said intake chamber, but preventing the discharge of said beads through said pervious barrier.

7. The apparatus according to claim 6, further comprising:

a outlet chamber in said housing;

said pervious barrier being located between said intake chamber and said outlet chamber for discharging air from said intake chamber into said outlet chamber; and a return air line connected to said outlet chamber for discharging air pressure from said outlet chamber.

8. The apparatus according to claim 7, wherein said conduit has an inner passage for delivering said beads and an outer annular passage, said return air line comprising said outer annular passage.

9. The apparatus according to claim 6, further comprising:

an auger located in the housing of the dispensing unit;

a motor connected to said auger for rotating said auger, which in turn moves said beads in said heating chamber toward said, wherein:

said auger has a hollow axially extending barrel having a sidewall;

said pervious barrier is located in a portion of said sidewall containing apertures that are too small for the beads of material to flow through; and wherein said pervious barrier allows air pressure from said conduit to flow into said barrel for discharge from said housing.

10. The apparatus according to claim 6, wherein said dispensing unit is a handheld gun.

11. An apparatus for dispensing melted material comprising:

a hopper adapted to contain beads of meltable material;

a housing having a forward end;

a hose having a first passage adapted to be connected to a conduit supplied with air pressure, said hose connected to said housing and said hopper for delivering said beads to said housing through said first passage;

a motor in said housing;

an auger operatively connected to said motor for forcing the beads received in said housing towards said forward end of said housing;

a nose assembly on a forward end of said housing;

a heating element in said nose assembly for melting said beads for dispensing said melted beads;

a pervious barrier in said housing for separating the beads from an airstream flowing through said hose, said hose having a second passage for return delivery of said separated airstream; and a controller that directs said feed screw to rotate.

12. The apparatus according to claim 11 wherein said nose assembly comprises:

a conical housing cone having a central orifice for delivery of melted beads;

a conical inductor received within said conical housing cone and having a central orifice;

a conical susceptor received within said conical inductor, said conical susceptor having a plurality of holes formed thereon and defining a central orifice, said conical susceptor defining an elastic zone between said conical susceptor and said beads;

a conical displacement cone received within said conical susceptor; and a nozzle containing said aperture and positioned within said central orifices of said conical housing, said conical inductor and said conical susceptor.

13. The apparatus according to claim 11 wherein upon a signal that operation of said apparatus is to cease, said controller reverses rotation of said auger by said motor a short amount.

14. The apparatus according to claim 11 wherein:

said first and second passages are concentric;

said first passage is an interior passage; and said second passage is an exterior annulus.

15. The apparatus according to claim 11 further comprising:

a metering device operatively connected to said hopper for metering an amount of beads into said airstream of said first passage of said hose.

* * * * *